United States Patent [19]

Whiteley

[11] 4,290,750

[45] Sep. 22, 1981

[54] CEMENTITIOUS PRODUCTS

[75] Inventor: Desmond Whiteley, Bedford, England

[73] Assignee: John Fletcher, Nottingham, England; a part interest

[21] Appl. No.: 53,769

[22] Filed: Jul. 2, 1979

[51] Int. Cl.[3] ..... F27B 7/02

[52] U.S. Cl. ..... 432/106; 432/118; 432/108; 241/171; 241/181

[58] Field of Search ..... 432/103, 105, 108, 110, 432/111, 118, 119, 106; 34/136, 134, 135, 137; 241/181, 171, 76–78; 51/164.1; 366/324, 328

[56] References Cited

U.S. PATENT DOCUMENTS

| | | | |
|---|---|---|---|
| 744,451 | 11/1903 | Abbe | 241/171 |
| 953,092 | 3/1910 | Kennedy | 241/171 |
| 2,410,598 | 11/1946 | Cliffe | 432/118 |
| 2,939,693 | 6/1960 | Old et al. | 432/110 |
| 3,780,447 | 12/1973 | Fales | 432/108 |
| 3,801,025 | 4/1974 | Slegton | 241/181 |
| 3,940,241 | 2/1976 | Houd | 432/80 |
| 3,955,917 | 5/1976 | Kratochvil | 432/106 |
| 3,964,717 | 6/1976 | Hansen | 241/171 |
| 3,990,644 | 11/1976 | Hanke et al. | 241/181 |
| 4,015,929 | 4/1977 | Kampstrup-Larsen | 432/119 |

*Primary Examiner*—Henry C. Yuen

*Attorney, Agent, or Firm*—Cahill, Sutton & Thomas

[57] ABSTRACT

A rotating kiln or cooler for use in the manufacture of cementitious materials comprises a tubular body (1) mounted for rotation about the longitudinal axis thereof, a material being fed into the body at one end and removed at the other end. Air or combustion gases flow through the body (1) in the opposite direction to the material.

In order to improve the heat transfer between the material and the air or gases, at least one ring (12) of lifting members (34) is provided on the interior periphery of the body (1). The members (34) lift the material and allow it to drop back to the bottom of the kiln, thus increasing the surface area of the material in contact with the air or gases.

10 Claims, 16 Drawing Figures

CEMENTITIOUS PRODUCTS

This invention if for improvements in or relating to the manufacture of cementitious materials and is particularly concerned with providing an improved method and apparatus for use in the manufacture of cementitious materials.

In the manufacture of cementitious materials it is known to provide a rotating kiln in which raw feed material is fed in at one end. The kiln is rotated and is inclined at an angle to the horizontal such that the raw feed is fed in at the upper end of the kiln and as the kiln rotates the raw feed has water evaporated therefrom (if the raw feed is wet) as a result of heat being applied to the lower end of the kiln. The raw feed gradually dries to a non-liquid state, carbon dioxide is driven off from what is then relatively solid material and then that material is rendered into a clinker in a zone of the furnace known as the burning zone, before being cooled.

Heat which is supplied to a kiln may either be by a burner using a fossil fuel such as for example, coal, oil or gas or the kiln may have heat supplied thereto by electricity.

The present invention is applicable to any form of a rotating kiln for use in the manufactue of a cementitious material.

It will be appreciated that in order to form the cementitious material the raw feed has not only to have the moisture evaporated therefrom, but has to be heated to a sufficiently high temperature in order to calcine the material into a cementitious clinker. This cementitious clinker after cooling is subsequently ground to a powder in a mill and mixed with other materials in order to form a cementitious product. The clinker is formed in the burning zone and it is necessary thereafter to cool that clinker for storage and subsequent transportation. It will be appreciated that the clinker possesses heat and if the clinker is allowed to leave the kiln with that heat, some of that heat will be wasted.

An object of the present invention is to remove some of the heat from the clinker as it is cooling and transfer it to the cooler air entering the kiln.

It will also be appreicated that at the entry of the raw feed to the kiln hot gases are leaving the kiln to pass up a chimney and it is an object of the present invention to transfer some of the heat from such hot gases to the raw feed as it enters the kiln.

Accordingly, the present invention provides a method of manufacturing a cementitious material in a rotating cement making kiln having gases passing therethrough which comprises rotating the kiln, providing at least one ring of lifting members for the material around the internal periphery of the kiln to lift the material from the bottom of the kiln and allowing the material to fall out of the lifting members to the bottom of the kiln.

In order to assist the transfer of heat between the gases within the kiln and the material which commences as the raw feed and exits the kiln as a cementitious clinker the invention provides for the lifting of the material from the bottom of the kiln along which it progresses. It will be appreciated that the material lies mainly on the bottom of the kiln and is lifted partly to one side as the kiln rotates. After a few degrees of rotation from the bottom the material falls back again to the bottom. It is desired therefore to lift the material further up the side of the kiln and over the top dead centre of the kiln in order to expose a greater surface of said material to the gases and thus to effect a better exchange of heat between the two. Such exchange of heat is from gases to raw feed at one end of the kiln and from hot clinker to cooler air at the other or lower end of the kiln, i.e. where the clinker leaves the kiln.

The term kiln as used herein includes not only a kiln in which the cementitious clinker is made but includes for the purposes of this specification a rotating member into which hot cementitious clinker may be fed for cooling thereof, such member will be rotatable about a substantially horizontal axis and cool air will enter such member and after exchange with the heated clinker the air passes into the kiln in which the raw feed is calcined to cementitious clinker.

Accordingly the present invention provides a rotating kiln for the manufacture of cementitious material said kiln comprising an elongate tubular member mounted for rotation about an axis inclined to the horizontal, means for feeding material into the kiln and means for permitting the exit of material from adjacent to the lower end of the kiln characterised in the provision of at least one ring of lifting members on the interior periphery of the kiln, said members having the means to lift the material from adjacent the bottom of the kiln and allow the material to drop back to the bottom of the kiln.

The lifting members have an inlet opening through which the material enters and an exit opening from which the material leaves and a passageway between the two openings so that as the kiln rotates, material held in the passageway between the two openings will subsequently fall from the said exit opening down to the bottom of the kiln again. The lifting members may comprise a series of tubes secured to the internal periphery of the kiln or they may be formed of refractory material by building blocks of desired material or of refractory material cast in situ within the kiln. The exit opening will desirably be of larger size than the inlet opening.

The lifting members will be in the form of a ring on the internal periphery of the kiln and a plurality of rings may be provided, each ring being separated by a banker ring or other means which restricts the flow of the material from one ring to the next, thus ensuring that the material is retained longer within the lifting members and thus lifted higher. The lifting members may if desired have a passageway extending radially inwardly so that the material may fall out of the lifting members apart from out of the exit opening of the members. The passageway through the lifting members from one opening to the other may either be parallel to the axis of rotation of the kiln or may be inclined thereto. Said angle of inclination may either be in the direction of rotation of the kiln in which event it will assist the material to pass more rapidly through the lifting member, or may be in the opposite direction to that of rotation of the kiln in which case it will reduce the speed at which the material passes through the lifting member.

By effecting a transfer of heat between the raw feed or cementitious clinker on the one hand and the gases in the kiln, it is thought that for the same amount of heat fed to the kiln a greater amount of cementitious clinker will be produced or alternatively less heat will be needed by the kiln to produce the same quantity of cementitious clinker.

Reference is made to the drawings, in which.

Figure 1:
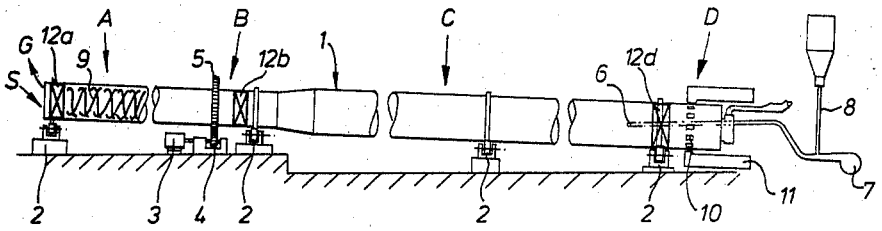
FIG. 1 is an elevation of a wet-feed cement kiln.

Referring first to FIG. 1, a cement kiln comprises an elongate tubular steel body 1 supported on roller 2 at a small inclination to the horizontal. The body 1 is rotated by means of an electric motor 3 turning a pinion 4 in engagement with a ring gear 5. The body 1 is lined with refractory bricks, which are not shown in detail. A burner pipe 6 extends into the body 1 from the lower end thereof and is supplied with air from a blower 7 and pulverised coal through a coal feed pipe 8.

The pulverised coal blown into the body 1 burns as a jet which strikes the brick lining of the body 1 (or rather, in use, the materials forming the cement clinker on the lining) raising the temperature to a level sufficient for the cement clinker forming reaction to occur.

The cement-forming materials are introduced in the form of an aqueous slurry into the body 1 of the kiln at the upper end thereof, as indicated by arrow S. The materials pass down the kiln through a conventional chain section 9, in which the slurry is dried and broken into a powder, and which forms part of pre-heating zone A, to a $CO_2$ zone B, in which carbon dioxide is driven off, and thence to a burning zone C, in which the temperature is sufficient to enable the cement clinker forming reaction to take place. The powdered materials fuse during the reaction and on moving down past the burning zone C into a cooling zone D form a cement clinker. The clinker leaves the body 1 through apertures 10, passing through heat exchanges 11 in which heat may be transferred to the combustion air entering the kiln, improving combustion efficiency.

Rings 12 of the lifting members which may, for example, have the form illustrated in any of FIGS. 4 to 16, as hereinafter described, are mounted within the kiln body 1 at a location just upstream of the apertures 10, just upstream of the burning zone C and at the upper end of the body 1. The lowermost rings 12*d* serve to transfer heat from the hot clinker to the combustion air passing up the body 1 towards the flame. The middle rings 12*b* transfer heat to the material from the hot gases from the burning zone, raising the temperature of the material more rapidly to that at which the carbon dioxide is driven off. The uppermost rings 12*a* transfer heat at a lower temperature from the gases leaving the kiln body in the direction of arrow G to the slurry entering the kiln body 1.

Figure 2:
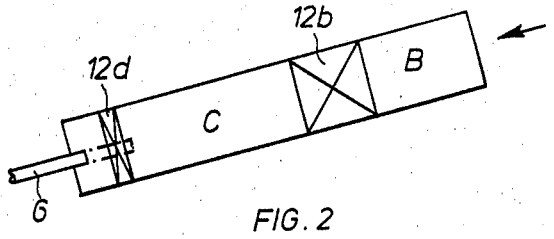
FIG. 2 is a diagrammatic representation of a dry-feed cement kiln.

The dry-feed kiln illustrated in FIG. 2 does not reuquire the long pre-heating drying zone used in wet-feed kilns. The combined pre-heating and $CO_2$ zone B has a series of rings 12*b* of lifting members in which the material is raised towards the burning temperature, and rings 12*d* adjacent to the clinker outlet of the kiln to cool the clinker and pre-heat the combustion air.

Figure 3:
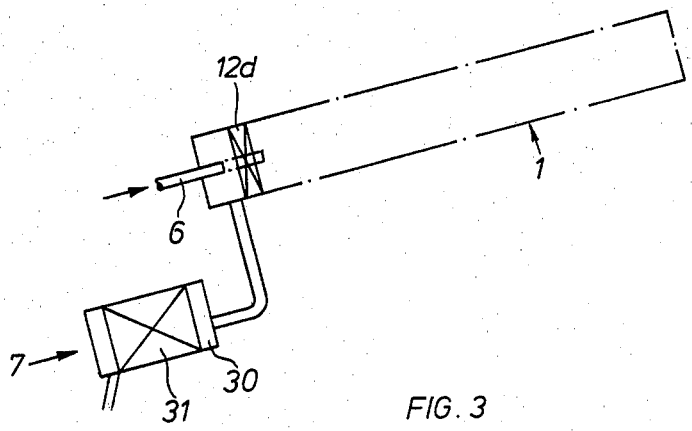
FIG. 3 is a diagrammatic representation of a cement kiln having a cooler.

The kiln body 1 of FIG. 3 may be of either the wet-feed or dry-feed type. The pre-cooled clinker leaving the lowermost rings 12*d* of lifting members passes into an external cooler 30 in which a series of rings 31 of lifting members is arranged. The cooler 30 rotates in a similar manner to the kiln, and air is passed through the cooler in the direction of arrow T, some of the air being drawn through the blower supplying air to the burner pipe 6. Very efficient heat transfer from the clinker to the air is obtained; the clinker leaving the cooler 30 can be sufficiently cool to handle manually.

Whilst the kilns described with reference to FIGS. 1, 2 and 3 are shown with coal or gas fired burners the invention is equally applicable to kilns having other forms of heating, for example electricity.

Figure 4:
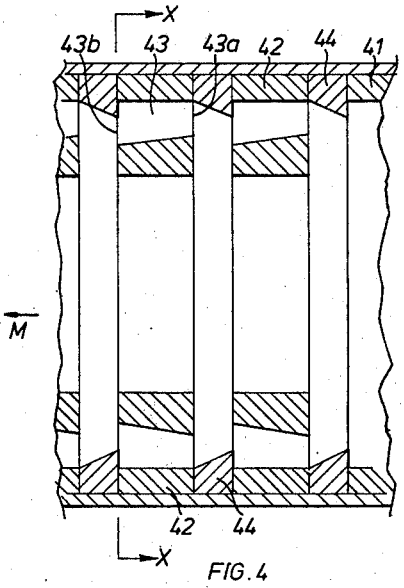
FIG. 4 is a longitudinal cross-section of a portion of a cement kiln having one form of lifting members.
Figure 5:
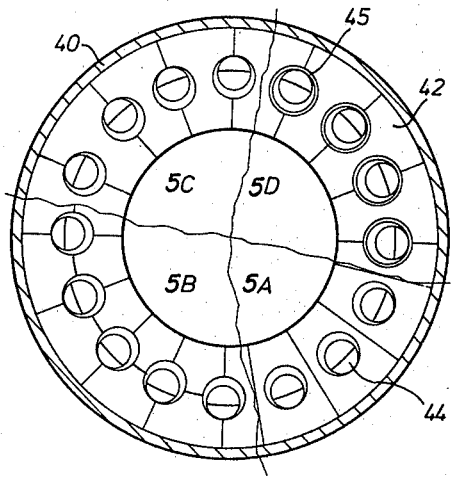
FIG. 5 is a section on the line x—x in FIG. 4, divided into four parts showing alternative constructions.

FIGS. 4 and 5 illustrate forms of lifting members which may be constructed in refractory brick or ceramic materials and thus be suitable for use in or near the high temperature burning zone C of the kiln. FIG. 5 is a view up the kiln toward the inlet for the materials.

The steel shell 40 of the kiln has a lining of refractory bricks 41 except where the rings of lifting members are provided. The lifting members are formed as refractory blocks 42 mounted around the inner surface of the shell 40. The blocks 42 have an inlet opening 43*a* through which the material passes to enter a passageway 43 leading to an exit opening 43*b* through which the material leaves the block 42. The surface of the passageways 43 are generally parallel to the surface of the shell 40 at their nearest points to the shell 40, but slope inwardly towards the axis of the kiln at their nearest points to the axis. Thus the inlet openings 43*a* are smaller than the exit openings 43*b*. Adjacent rings of blocks 42 are separated from each other by banker rings 44 formed of refractory bricks which are tapered on the surface facing inwardly of the kiln. these banker rings serve to reduce further the size of the inlet openings 43*a* thereby holding back the material in its passage down the kiln and allowing time for the rotation of the kiln to lift the material up the side of the kiln. The sectors 5A, 5B, 5C and 5D show alternative arrangements of refractory block 42 which can make up the rings of lifting members. Sector 5D shows the passageway 43 having a tapered tubular lining member 45 which may serve to reduce abrasion of the blocks by material passing through the passageway 43. The lining members 45 will be formed of a refractory material, which may be a seramic or a metal, where the rings are located at a high temperature zone of the kiln.

In use, the material will flow down the kiln in the direction of arrow M in FIG. 4. The lifting members serve several main functions. Firstly, the material tends to bank up on the upstream side of each ring and this causes the material to ride higher up the side of the kiln as the kiln rotates, thus presenting a larger surface area to the gases flowing up the kiln. Secondly, some of the material is carried around the kiln, as it rotates, by the passageways 43. Thirdly, some of the material carried by the passageways 43 tend to fall out as the blocks pass over the top of their rotation path, the inward taper of the passageway 43 assisting this falling out, the resultant fall of material, which may form a 'curtain' across the kiln, greatly increasing the surface area of material in contact with the gases. Fourthly, as the material passes through the passageway 43 in the blocks, heat is transferred between the blocks and the material, and as the blocks travel around the remainder of their circular path they are again heated or cooled by the gases flowing in the kiln. The direction of heat transfer will depend upon the location of the rings; upstream of the burning zone heat is transferred from the gases to the material via the blocks, and downstream heat is transferred from the material to the air.

The banker rings 44 delay passage of the material down the kiln through the rings and thus serve to increase contact time of the material with the rings and thus heat transfer. In some constructions the banker rings may be omitted.

Figure 7:
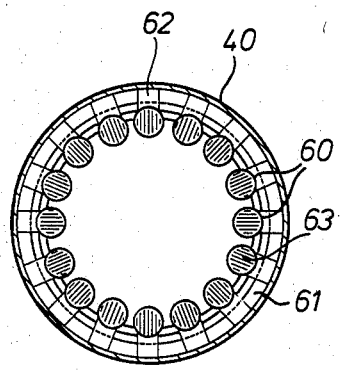
FIG. 7 is a section on line y—y in FIG. 6.
Figure 6:
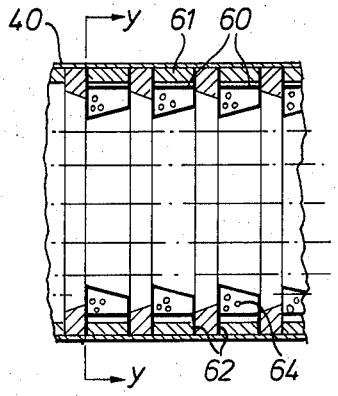
FIG. 6 is a longitudinal cross-section of a portion of a cement kiln having an alternative form of lifting members.

The lifting members shown in FIGS. 6 and 7 are intended primarily for use at the uppermost end of a wet-feed kiln, the members comprising tapered tubular steel bodies 60 mounted on the lining bricks 61 of the shell 40 of the kiln by means of brackets 62 passing through or between the bricks 61 and welded to the inner surface of the shell 40. The bodies 60 are partially closed at each end by steel grilles 63, and contain steel balls 64, or similar pieces of metal, which serve to scour the insides of the bodies 60, preventing blockage by the slurry passing through in addition to further improving heat transfer. Banker rings 44, as described with reference to FIGS. 4 and 5, separate the rings or bodies 60.

Figure 8:
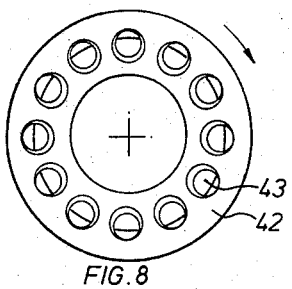
FIG. 8 to 16 are cross-sections corresponding to FIGS. 10, 11, 13, 14 and 15 being divided into three parts and FIG. 16 into two parts, each part in any one Figure showing alternative configurations for lifting members of the same general shape.
Figure 10:
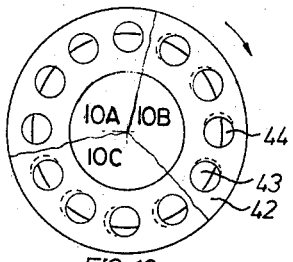
Figure 9:
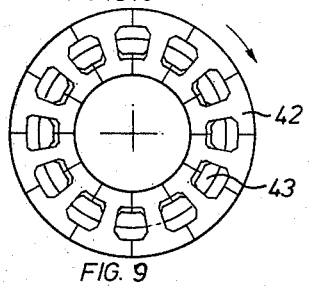
Figure 11:
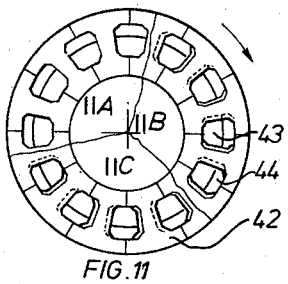

FIGS. 8 to 11 show alternative shapes of passageways through the rings of lifting members, similar to those shown in FIGS. 4 and 5. In FIGS. 8 and 9, tapered passageways are shown as before, whilst in FIGS. 10 and 11, untapered passageways are shown. Sectors 10A and 11A show passageways whose axes are parallel to that of the kiln, whilst Sectors 10B and 11B show passageways whose axes are inclined to the direction of rotation of the kiln so as to slow the passage of material through the lifting members. The inclination referred to is clearly illustrated in the Figures. The passageways shown in Sectors 10C and 11C are inclined in the opposite direction of the passageways of Sectors 10B and 11B so as to accelerate the flow of material through the lifting member. These alternative configurations enable control to be exercised locally of the flow rate and hence heat transfer. Combinations of such different rings may be used.

Figure 12:
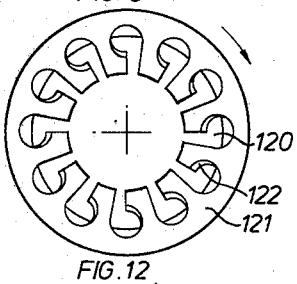
Figure 13:
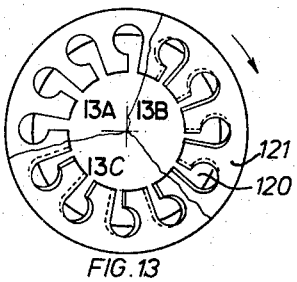

FIGS. 12 to 16 show various forms of an alternative arrangement of lifting members having passageways 120 through the blocks 121 forming the ring, the passageways 120 also opening radially inwardly of the kiln. This arrangement ensures that a greater proportion or all of the material carried up in the passageways falls out as the passageways pass over the top of their path. FIG. 12 shows passageways having an inner surface 122 which is inwardly tapered in the same manner as the inner surface of the passageways in, for example, the embodiment of FIG. 8, to assist the material in falling out. FIG. 13 shows three sets of passageways similar to that of FIG. 12, but without the inward taper. In Sector A of FIG. 13 the passageways pass straight through the ring, whilst in Sectors B and C the passageways are inclined relative to the direction of rotation of the kiln so as to slow passage to the material, in the case of 13B, or accelerate, in the case of 13C.

Figure 14:
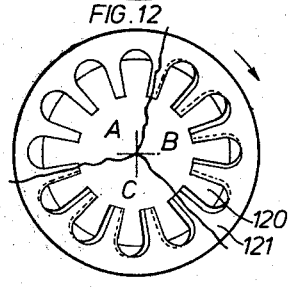
Figure 16:
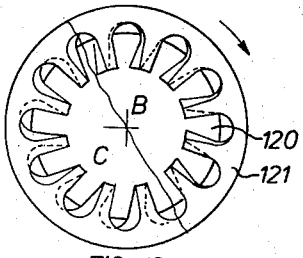
Figure 15:
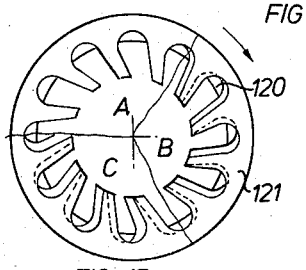

FIGS. 14 and 15 are generally similar to FIG. 13, showing alternative shapes of passageways, whilst FIG. 16 shows passageways which are twisted, rather than simply inclined to the kiln axis, the type shown in Sector B tending to slow the material, whilst that in Sector C tends to accelerate its passage down the kiln.

All rings of FIGS. 8 to 16 are shown from a position looking up the kiln towards the end at which the materials are introduced into the kiln. The rings may be formed from blocks of any suitable shape, as shown in FIG. 5.

A kiln having lifting members as described will, by virtue of the more efficient heat ransfer to and from the material passing through it, the sintering process depending less on radiant heat from the lining, wasteless heat by radiation from the kiln and in the gases and clinker leaving the kiln. Thus the throughput may be increased for a given energy consumption, or the energy consumption may be reduced for a given throughput of material.

A new kiln in accordance with the invention may be built shorter than conventional kilns of the same capacity, with consequent savings in capital expenditure.

I claim:

1. A rotating kiln for the manufacture of cementitious material, said kiln comprising in combination:

(a) an elongated tubular member mounted for rotation about an axis inclined to the horizontal and having a lower end, the central cross-section of said tubular member being free from any fixed obstruction to the flow of gases through said tubular member;

(b) means for feeding a material into said tubular member;

(c) means for permitting the exit of material from adjacent to the lower end of said tubular member;

(d) at least one lifting device, each said lifting device including:

i. at least one ring, each said ring including a plurality of lifting members rigidly fixed to the interior periphery of said tubular member and extending radially inwardly of said tubular member for lifting material from adjacent to the bottom of said tubular member and for allowing the material to drop back to the bottom of said tubular member, each said lifting member including an inlet opening through which the material enters said lifting member, an outlet opening from which the material leaves said lifting member and a passageway for the material between said inlet and outlet openings; and ii. banker rings disposed intermediate said rings for delaying passage of the material through said passageway of said lifting members in said rings said banker rings including means for restricting said outlet openings of said lifting members.

2. The kiln as set forth in claim 1 wherein said banker rings include means for encouraging flow of material into said inlet openings in said lifting members of the next downstream one of said rings.

3. The kiln as set forth in claim 1 wherein said banker rings extend radially inwardly of the inner surface of said tubular member.

4. The kiln as set forth in claim 1 wherein said banker rings extend radially inwardly of the inner surface of said tubular member intermediate adjacent ones of said rings.

5. The kiln as set forth in claim 1 including at least two of said lifting devices located mutually adjacent one another and means for restricting said inlet openings through which the material enters said lifting members.

6. The kiln as set forth in claim 5 wherein said passageway of each said lifting member includes a radially inwardly directed further passageway from which the material may leave said lifting member.

7. The kiln as set forth in any of claims 5, 6 or 1 wherein each said ring of lifting members comprises a plurality of blocks refractory material, said blocks being contoured to provide said inlet opening, said outlet opening and said passageway.

8. The kiln as set forth in claim 1 wherein said tubular member includes a preheating zone, a burning zone and a cooling zone and wherein at least one of said rings of lifting members is disposed within said cooling zone.

9. The kiln as set forth in claim 8 wherein at least one of said rings of lifting members is disposed in proximity to said cooling zone.

10. The kiln as set forth in claim 9 wherein at least one of said rings of lifting members is disposed in proximity to said burning zone.

* * * * *

UNITED STATES PATENT AND TRADEMARK OFFICE

CERTIFICATE OF CORRECTION

PATENT NO. : 4,290,750

DATED : September 22, 1981

INVENTOR(S) : Desmond Whiteley

It is certified that error appears in the above—identified patent and that said Letters Patent is hereby corrected as shown below:

On the title page Insert

-- (30) Foreign Application Priority Data

November 11, 1977 United Kingdom 46544/77 --

Signed and Sealed this

*Thirteenth* Day of *April 1982*

[SEAL]

*Attest:*

*Attesting Officer*

GERALD J. MOSSINGHOFF

*Commissioner of Patents and Trademarks*